US012716181B2

(12) United States Patent
Elmore et al.

(10) Patent No.: US 12,716,181 B2
(45) Date of Patent: Aug. 25, 2026

(54) HINGE FOR USE WITH A ROADWAY BARRIER SYSTEM

(71) Applicant: Lindsay Transportation Solutions, LLC, Omaha, NE (US)

(72) Inventors: Matthew A. Elmore, Rio Vista, CA (US); John James Angus, Omaha, NE (US); Daniel Paul Dacayanan Loya, Elk Grove, CA (US); Jason T. Lim, Stockton, CA (US)

(73) Assignee: Lindsay Transportation Solutions, LLC, Omaha, NE (US)

( * ) Notice: Subject to any disclaimer, the term of this patent is extended or adjusted under 35 U.S.C. 154(b) by 438 days.

(21) Appl. No.: 18/524,188

(22) Filed: Nov. 30, 2023

(65) Prior Publication Data

US 2025/0179746 A1 Jun. 5, 2025

(51) Int. Cl.
*E01F 15/08* (2006.01)

(52) U.S. Cl.
CPC ..... *E01F 15/088* (2013.01)

(58) Field of Classification Search
CPC ..... E01F 15/088
USPC ..... 404/6
See application file for complete search history.

(56) References Cited

U.S. PATENT DOCUMENTS 4,681,302 A 7/1987 Thompson
4,828,425 A 5/1989 Duckett
6,413,009 B1 7/2002 Duckett
6,428,237 B1 8/2002 Duckett
6,811,144 B2 11/2004 Denman et al.
8,777,510 B2 7/2014 Maus et al.
9,133,591 B2 9/2015 Maus et al.
9,145,652 B2 9/2015 Maus et al.
9,822,503 B2 11/2017 Maus et al.
10,214,866 B2 2/2019 Maus et al.
(Continued)

FOREIGN PATENT DOCUMENTS

WO WO-2025117357 A1 * 6/2025 ..... E01F 15/088

OTHER PUBLICATIONS

Lindsay—Absorb 350, Non-Redirective Crash Cushion—Sacrificial, Webpage <https://www.lindsay.com/uploads/files/sections/952-PI%20Sheet%20-%20ABSORB%20350.pdf>, 2020, 2 pages.
(Continued)

*Primary Examiner* — Raymond W Addie
(74) *Attorney, Agent, or Firm* — HOVEY WILLIAMS LLP

(57) ABSTRACT

A collapsible hinge for use with a roadway barrier system including a plurality of barriers comprises a first hinge assembly, a second hinge assembly, and a pin. The first hinge assembly is connected to an end wall of a first barrier and includes a first base and a second base. The first base includes upper and lower surfaces and an opening extending from the upper surface to the lower surface. The second base includes upper and lower surfaces and an opening extending from the upper surface to the lower surface. The second hinge assembly is connected to an end wall of a second barrier and includes a first base and a second base, each having the same construction as the first and second base, respectively, of the first hinge assembly. The pin is positioned in the opening of each base of each hinge assembly.

19 Claims, 16 Drawing Sheets

(56) References Cited

U.S. PATENT DOCUMENTS

| | | | | |
|---|---|---|---|---|
| 10,544,555 | B1 * | 1/2020 | Lim | E01F 15/08 |
| 10,822,756 | B2 | 11/2020 | Maus et al. | |
| 2008/0175661 | A1 | 7/2008 | Dyke et al. | |
| 2020/0149235 | A1 | 5/2020 | Wawrzynek | |
| 2020/0270831 | A1 * | 8/2020 | Allen | E01F 13/046 |

OTHER PUBLICATIONS

Sled Sentry Longitudinal Energy Dissipater, MASH (Manual for Assessing Safety Hardware), Webpage <https://www.traffixdevices.com/products/attenuators/sled-us>, 7 pages.

International Search Report and Written Opinion in related PCT Application PCT/US2024/057026 mailed Mar. 11, 2025, 10 pages.

* cited by examiner

HINGE FOR USE WITH A ROADWAY BARRIER SYSTEM

BACKGROUND OF THE INVENTION

A roadway barrier system includes a first end barrier, a spaced-apart second end barrier, and a plurality of intermediate barriers positioned therebetween. Each pair of adjacent barriers is rotatably coupled to one another with a hinge.

SUMMARY OF THE INVENTION

Embodiments of the current invention provide a collapsible hinge for use with a roadway barrier system that includes components which buckle or bend when a vehicle impacts the system from the front. The collapsible hinge broadly comprises a first hinge assembly, a second hinge assembly, and a pin. The first hinge assembly is connected to an end wall of a first barrier and includes a first base and a second base. The first base includes upper and lower surfaces and an opening extending from the upper surface to the lower surface. The second base includes upper and lower surfaces and an opening extending from the upper surface to the lower surface. The second hinge assembly is connected to an end wall of a second barrier and includes a first base and a second base. The first base includes upper and lower surfaces and an opening extending from the upper surface to the lower surface. The second base includes upper and lower surfaces and an opening extending from the upper surface to the lower surface. The first base or the second base of the second hinge assembly is positioned between the first base and the second base of the first hinge assembly. The pin is positioned in the opening of each base of each hinge assembly.

Another embodiment of the collapsible hinge broadly comprises a first hinge assembly, a second hinge assembly, and a pin. The first hinge assembly is connected to an end wall of a first barrier and includes a first base, a first left arm, a first right arm, a second base, a second left arm, and a second right arm. The first base includes an upper surface, a lower surface, and a front surface. The first left arm and the first right arm are each connected to the front surface of the first base. The second base includes an upper surface, a lower surface, and a front surface. The second left arm and the second right arm are each connected to the front surface of the second base. The second hinge assembly is connected to an end wall of a second barrier and includes a first base, a first left arm, a first right arm, a second base, a second left arm, and a second right arm. The first base includes an upper surface, a lower surface, and a front surface. The first left arm and the first right arm are each connected to the front surface of the first base. The second base includes an upper surface, a lower surface, and a front surface. The second left arm and the second right arm are each connected to the front surface of the second base. For each hinge assembly, the first left arm, the first right arm, the second left arm, and the second right arm each buckle or bend during a front impact to the roadway barrier system. The pin is coupled to each base of each hinge assembly.

Yet another embodiment of the collapsible hinge broadly comprises a first hinge assembly, a second hinge assembly, and a pin. The first hinge assembly is connected to an end wall of a first barrier and includes a first base, a first left arm, a first right arm, a second base, a second left arm, a second right arm, a left arm connector, and a right arm connector. The first base includes an upper surface, a lower surface, a front surface, an opening extending from the upper surface to the lower surface, and a first bushing positioned in the opening. The first left arm and the first right arm are each connected to the front surface of the first base. The second base includes an upper surface, a lower surface, a front surface, an opening extending from the upper surface to the lower surface, and a second bushing positioned in the opening. The left arm connector connects the first left arm to the second left arm, and the right arm connector connects the first right arm to the second right arm. The second hinge assembly is connected to an end wall of a second barrier and includes a first base, a first left arm, a first right arm, a second base, a second left arm, a second right arm, a left arm connector, and a right arm connector. The first base includes an upper surface, a lower surface, a front surface, an opening extending from the upper surface to the lower surface, and a first bushing positioned in the opening. The first left arm and the first right arm are each connected to the front surface of the first base. The second base includes an upper surface, a lower surface, a front surface, an opening extending from the upper surface to the lower surface, and a second bushing positioned in the opening. The left arm connector connects the first left arm to the second left arm, and the right arm connector connects the first right arm to the second right arm. The first base or the second base of the second hinge assembly is positioned between the first base and the second base of the first hinge assembly. For each hinge assembly, the first left arm, the first right arm, the second left arm, and the second right arm each buckle or bend during a front impact to the roadway barrier system. The pin is positioned in the first bushing and the second bushing of each hinge assembly.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF DRAWINGS

Embodiments of the current invention are described in detail below with reference to the attached drawing figures, wherein.

Figure 1:
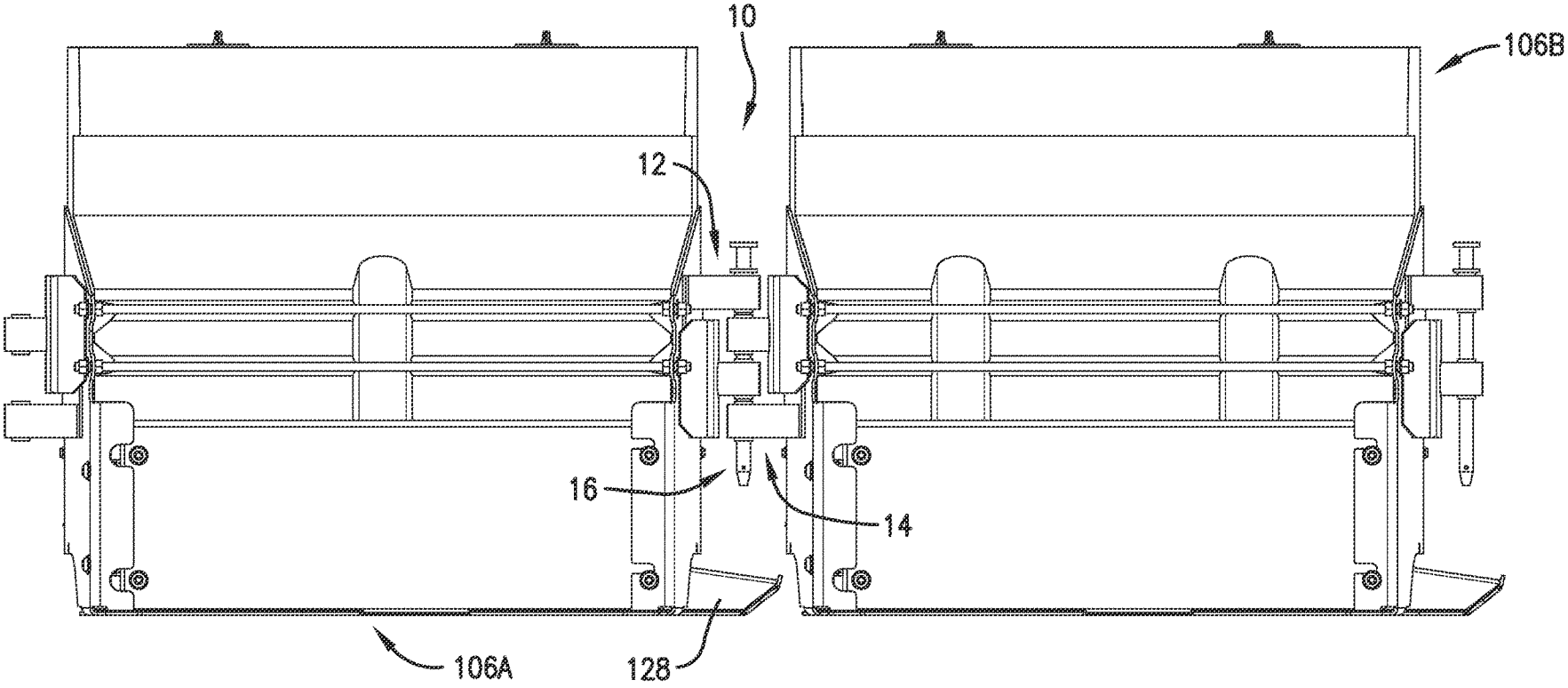
FIG. 1 is a side view of a collapsible hinge, constructed in accordance with various embodiments of the current invention, for use with a roadway barrier system, from which, first and second intermediate barriers are shown, the collapsible hinge including a first hinge assembly, a second hinge assembly, and a pin.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE INVENTION

The following detailed description of the technology references the accompanying drawings that illustrate specific embodiments in which the technology can be practiced. The embodiments are intended to describe aspects of the technology in sufficient detail to enable those skilled in the art to practice the technology. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

A collapsible hinge 10, constructed in accordance with various embodiments of the current invention, is shown in FIGS. 1, 2, and 4-10. A plurality of collapsible hinges 10 is utilized with a roadway barrier system 100 shown in FIG. 3. The roadway barrier system 100 includes a first end barrier 102 positioned at a first end, a second end barrier 104 positioned at a second end, and a plurality of intermediate barriers 106 positioned therebetween. Each type of barrier 102, 104, 106 has a general rectangular box shape and includes at least a first end wall 108 and a second end wall 110.

Figure 3:
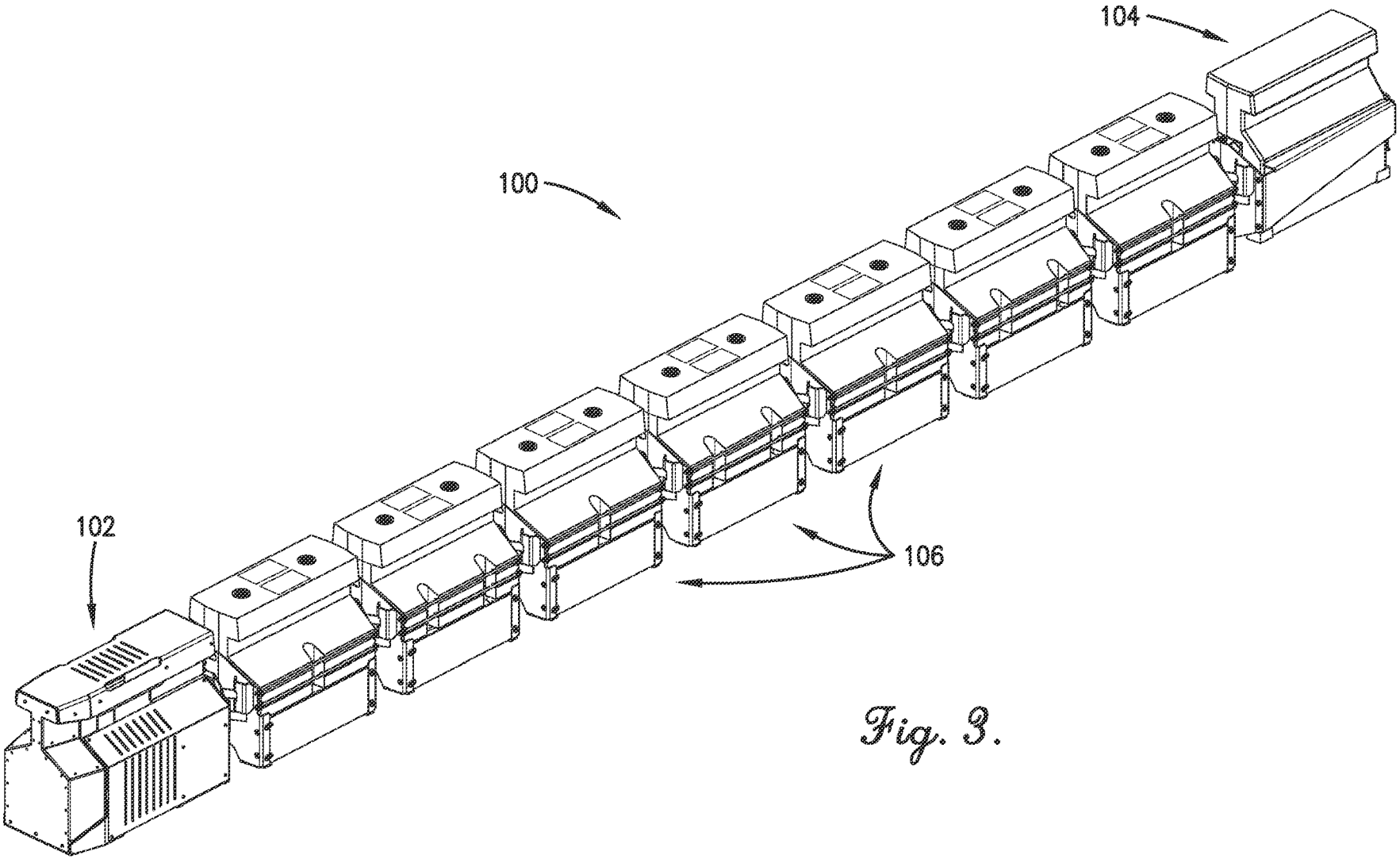
FIG. 3 is an upper perspective view of the roadway barrier system, the system further including a first end barrier, a plurality of intermediate barriers, and a second end barrier.
Figure 4:
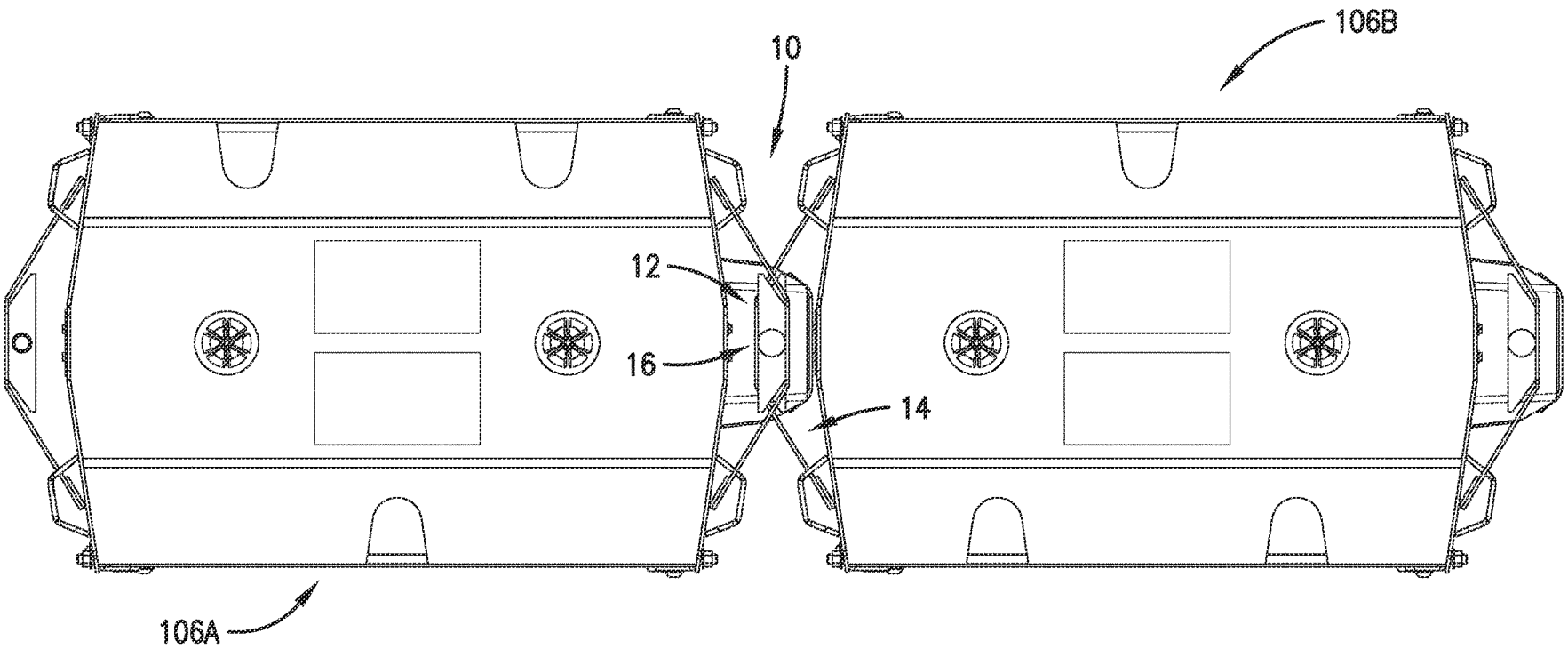
FIG. 4 is a top view of the collapsible hinge and the first and second intermediate barriers.
Figure 5:
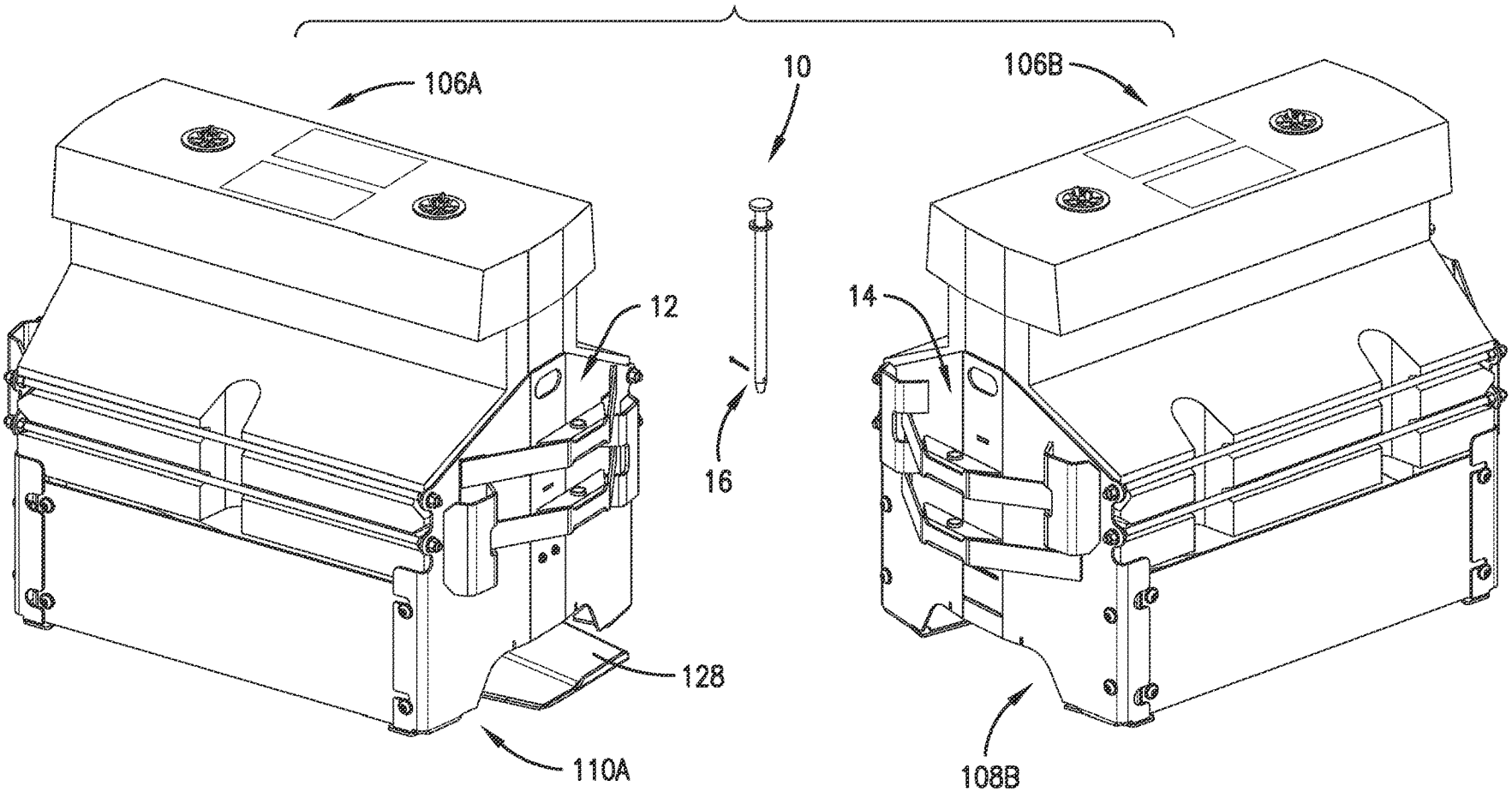
FIG. 5 is an upper perspective view of the collapsible hinge and the first and second intermediate barriers with the first hinge assembly, the second hinge assembly, and the pin separated from one another.

The first end barrier 102 and the second end barrier 104 are each coupled to a separate intermediate barrier 106, and the intermediate barriers 106 are coupled to one another in pairs to form a chain. Shown in FIGS. 1, 4, and 5 are a first intermediate barrier 106A and a second intermediate barrier 106B. Each collapsible hinge 10 is used to rotatably couple successive pairs of adjacent barriers 102, 104, 106 to one another. Although the barriers 102, 104, 106 can rotate relative to one another, the barriers 102, 104, 106 are typically positioned to form a straight line, as shown in FIG. 3. The rotational capabilities provided by the collapsible hinge 10 are only used during transportation of the roadway barrier system 100.

Figure 6:
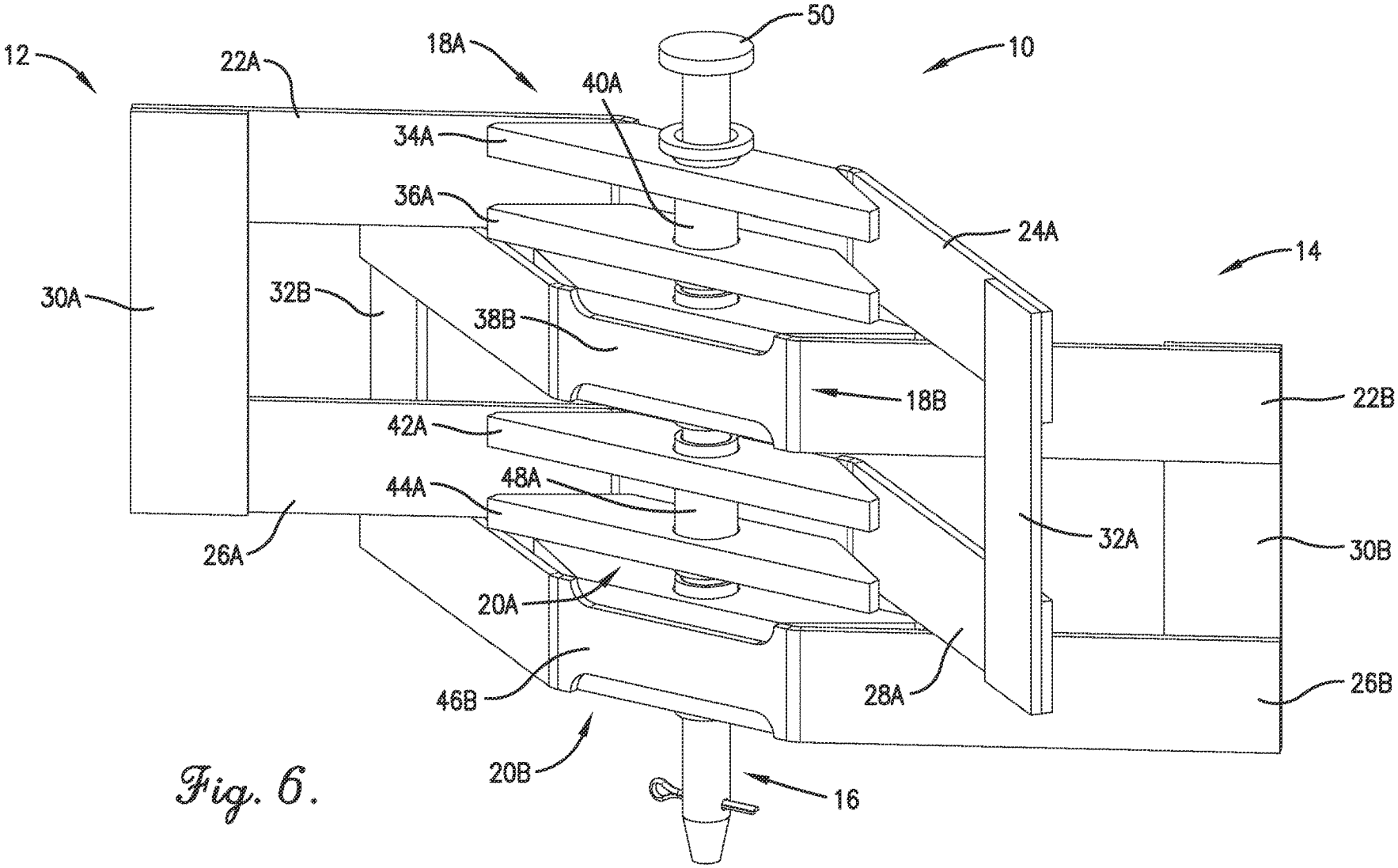
FIG. 6 is a perspective view from the rear of the first hinge assembly of the collapsible hinge in isolation.
Figure 7:
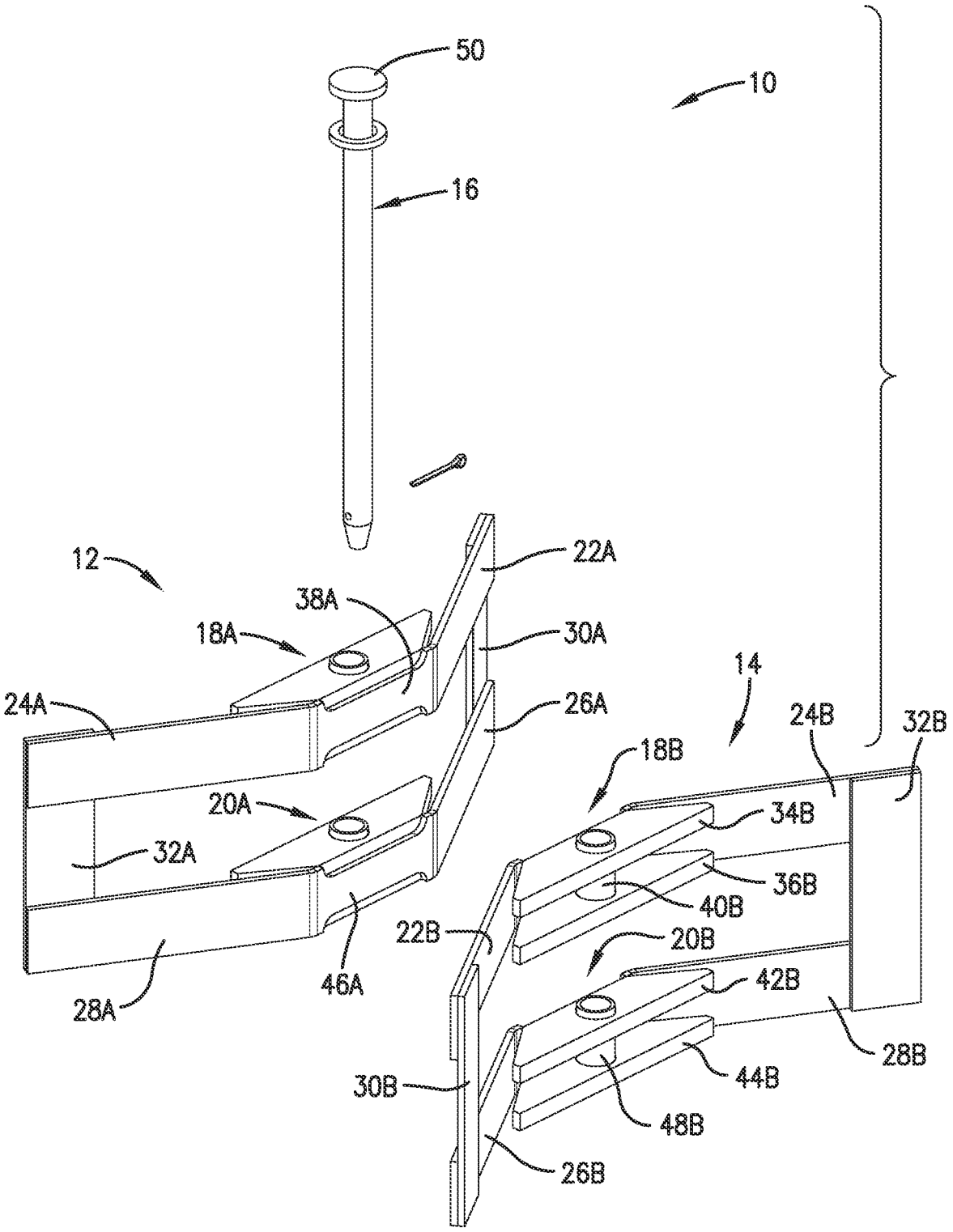
FIG. 7 is an exploded perspective view from the rear of the second hinge assembly of the collapsible hinge in isolation.
Figure 8:
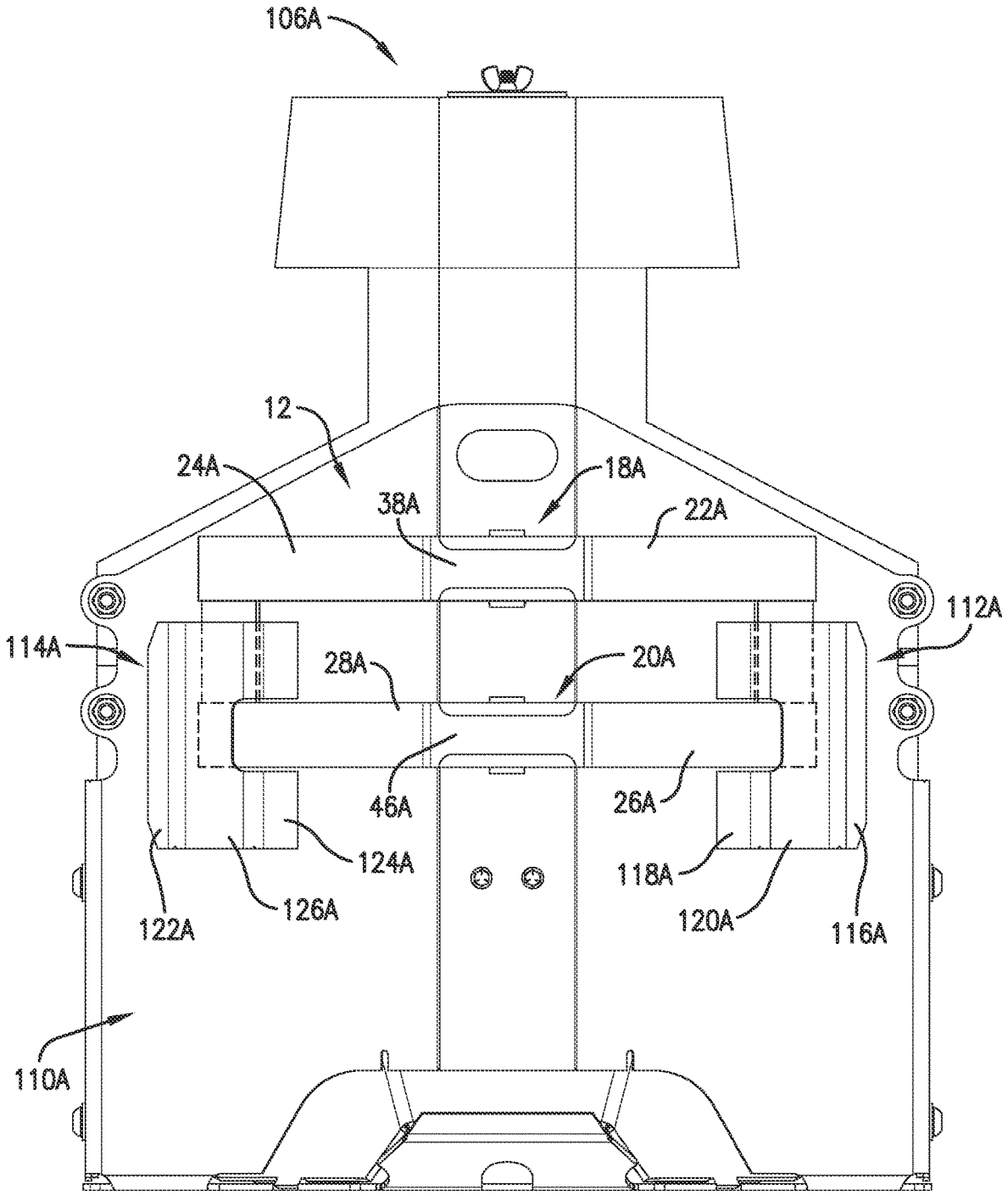
FIG. 8 is a second end view of the first intermediate barrier showing just the first hinge assembly.

The collapsible hinge 10 broadly comprises a first hinge assembly 12, a second hinge assembly 14, and a pin 16, as shown in isolation in FIGS. 6 and 7. The hinge assemblies 12, 14 have the same, or a similar, structure, and each hinge assembly 12, 14 includes a first base 18A, 18B, a second base 20A, 20B, a first left arm 22A, 22B, a first right arm 24A, 24B, a second left arm 26A, 26B, a second right arm 28A, 28B, a left arm connector 30A, 30B, and a right arm connector 32A, 32B. In some embodiments, each hinge assembly 12, 14 may include one or more additional bases and arms that are spaced apart from the bases and arms, described below. The first base 18A, 18B includes an upper plate 34A, 34B, a lower plate 36A, 36B, a front plate 38A, 38B, and a bushing 40A, 40B, and the second base 20A, 20B includes an upper plate 42A, 42B, a lower plate 44A, 44B, a front plate 46A, 46B, and a bushing 48A, 48B. Each of the upper plate 34A, 34B, 42A, 42B and the lower plate 36A, 36B, 44A, 44B includes an upper surface, a lower surface, a front surface, a back surface, and left and right side surfaces, and the upper surface and the lower surface each have a general trapezoidal shape. Each of the upper plate 34A, 34B, 42A, 42B and the lower plate 36A, 36B, 44A, 44B further includes a circular opening from the upper surface to the lower surface positioned roughly in a center of the plate. In some embodiments, the first base 18A, 18B and the second base 20A, 20B may each include a single plate that is roughly the size and shape of the upper plate 34A, 34B, 42A, 42B, the lower plate 36A, 36B, 44A, 44B, and the front plate 38A, 38B, 46A, 46B, in combination. The front plate 38A, 38B, 46A, 46B may have a generally quadrilateral shape and includes at least a right surface, a left surface, a front surface and a back surface.

The upper plate 34A, 34B, 42A, 42B is spaced apart from, and in alignment with, the lower plate 36A, 36B, 44A, 44B with the lower surface of the upper plate 34A, 34B, 42A, 42B facing the upper surface of the lower plate 36A, 36B, 44A, 44B. The front surface of each of the upper plate 34A, 34B, 42A, 42B and the lower plate 36A, 36B, 44A, 44B is connected to a successive portion of the back surface of the front plate 38A, 38B, 46A, 46B.

The bushing 40A, 40B, 48A, 48B has a generally hollow cylindrical shape and is positioned in the opening of each of the upper plate 34A, 34B, 42A, 42B and the lower plate 36A, 36B, 44A, 44B.

The first left arm 22A, 22B, the second left arm 26A, 26B, the first right arm 24A, 24B, and the second right arm 28A, 28B each have a generally planar quadrilateral shape with a front surface, a back surface, an upper surface, a lower surface, a left surface, and a right surface. For the first base 18A, 18B, the first left arm 22A, 22B is connected to a left side of the front plate 38A, 38B, and the first right arm 24A, 24B is connected to a right side of the front plate 38A, 38B. For the second base 20A, 20B, the second left arm 26A, 26B is connected to a left side of the front plate 38A, 38B, and the second right arm 28A, 28B is connected to a right side of the front plate 38A, 38B.

The left arm connector 30A, 30B and the right arm connector 32A, 32B each have a generally planar quadrilateral shape with a front surface, a back surface, an upper surface, a lower surface, a left surface, and a right surface. The left arm connector 30A, 30B is connected to the first left arm 22A, 22B and the second left arm 26A, 26B such that a portion of the back surface of each arm 22A, 22B, 26A, 26B is in contact with a successive portion of the front surface of the left arm connector 30A, 30B. The right arm connector 32A, 32B is connected to the first right arm 24A, 24B and the second right arm 28A, 28B such that a portion of the back surface of each arm 24A, 24B, 28A, 28B is in contact with a successive portion of the front surface of the right arm connector 32A, 32B.

The pin 16 has a generally cylindrical structure that tapers to a point at a lower end and is attached to a disc shaped cap 50 at an upper end. The pin 16 further includes an opening or a hole adjacent to the lower end through which a cotter pin or similar locking component is positioned.

The collapsible hinge 10 has a structure as follows. Referring to FIGS. 2 and 4-9, the first hinge assembly 12 is coupled to the second end wall 110A of the first intermediate barrier 106A, such that the left arm connector 30A and the right arm connector 32A are each rigidly attached to, such as by welding, an outer surface of the second end wall 110A. The second hinge assembly 14 is coupled to the first end wall 108B of the second intermediate barrier 106B, such that the left arm connector 30B and the right arm connector 32B are each rigidly attached to, such as by welding, an outer surface of the first end wall 108B.

The first hinge assembly 12 is coupled to the second end wall 110A at a location that is vertically offset from a location where the second hinge assembly 14 is coupled to the first end wall 108B, as shown in FIG. 1. Generally, a vertical center of either one of the hinge assemblies 12, 14 is aligned with a vertical center of either one of the first base 18A, 18B or the second base 20A, 20B of the other hinge assemblies 12, 14. In the exemplary embodiment shown in FIG. 1, the first hinge assembly 12 is positioned on the second end wall 110A of the first intermediate barrier 106A such that its vertical center is aligned with the vertical center of the first base 18B of the second hinge assembly 14 (positioned on the first end wall 108B of the second intermediate barrier 106B).

Given that the first base 18A, 18B, the first left arm 22A, 22B, and the first right arm 24A, 24B are spaced apart from the second base 20A, 20B, the second left arm 26A, 26B, and the second right arm 28A, 28B, respectively, each base-left arm-right arm combination acts like a "knuckle" of a traditional hinge. And, since the first hinge assembly 12 is vertically offset from the second hinge assembly 14 as described above, the first base 18B of the second hinge assembly 14 is positioned between the first base 18A and the second base 20A of the first hinge assembly 12. The second base 20A of the first hinge assembly 12 is positioned between the first base 18B and the second base 20B of the second hinge assembly 14. The pin 16 is positioned in the first bushing 40A, 40B, 48A, 48B and the second bushing 40A, 40B, 48A, 48B of the first hinge assembly 12 and of the second hinge assembly 14.

The barriers 102, 104, 106 further include a plurality of bumpers which play a role when there is a frontal impact to the roadway barrier system 100, as shown in FIGS. 1, 2, 4, 5, and 8-10. Specifically, the second end wall 110A of the first intermediate barrier 106A includes a left bumper 112A and a right bumper 114A. The first end wall 108B of the second intermediate barrier 106B includes a left bumper 112B and a right bumper 114B.

Each left bumper 112A, 112B includes an outer wall 116A, 116B, an inner wall 118A, 118B, and a center wall 120A, 120B coupled to the outer wall 116A, 116B and the inner wall 118A, 118B at opposing side edges. Each right bumper 114A, 114B includes an outer wall 122A, 122B, an inner wall 124A, 124B, and a center wall 126A, 126B coupled to the outer wall 122A, 122B and the inner wall 124A, 124B at opposing side edges. The outer wall 116A, 116B, 122A, 122B and the inner wall 118A, 118B, 124A, 124B are each rigidly attached to, such as by welding, the outer surface of the first end wall 108B or the second end wall 110A, and extend outward therefrom at an angle between 0 degrees and 90 degrees. Each inner wall 118A, 118B, 124A, 124B includes a cutout roughly midway along the vertical length thereof.

The left bumper 112A is positioned on the second end wall 110A of the first intermediate barrier 106A such that the second left arm 26A of the first hinge assembly 12 extends through the cutout of the inner wall 118A. The right bumper 114A is positioned on the second end wall 110A of the first intermediate barrier 106A such that the second right arm 28A extends through the cutout of the inner wall 124A. The left bumper 112B is positioned on the first end wall 108B of the second intermediate barrier 106B such that the first left arm 22B of the second hinge assembly 14 extends through the cutout of the inner wall 118B. The right bumper 114B is positioned on the first end wall 108B of the second intermediate barrier 106B such that the second right arm 28B extends through the cutout of the inner wall 124B.

During a frontal impact to the roadway barrier system 100, a vehicle strikes the first end wall 108 of the first end barrier 102 (shown in FIG. 3). The impact of the vehicle forces each barrier 102, 104, 106 into the one after it in succession, depending on the mass and velocity of the vehicle.

Figure 2:
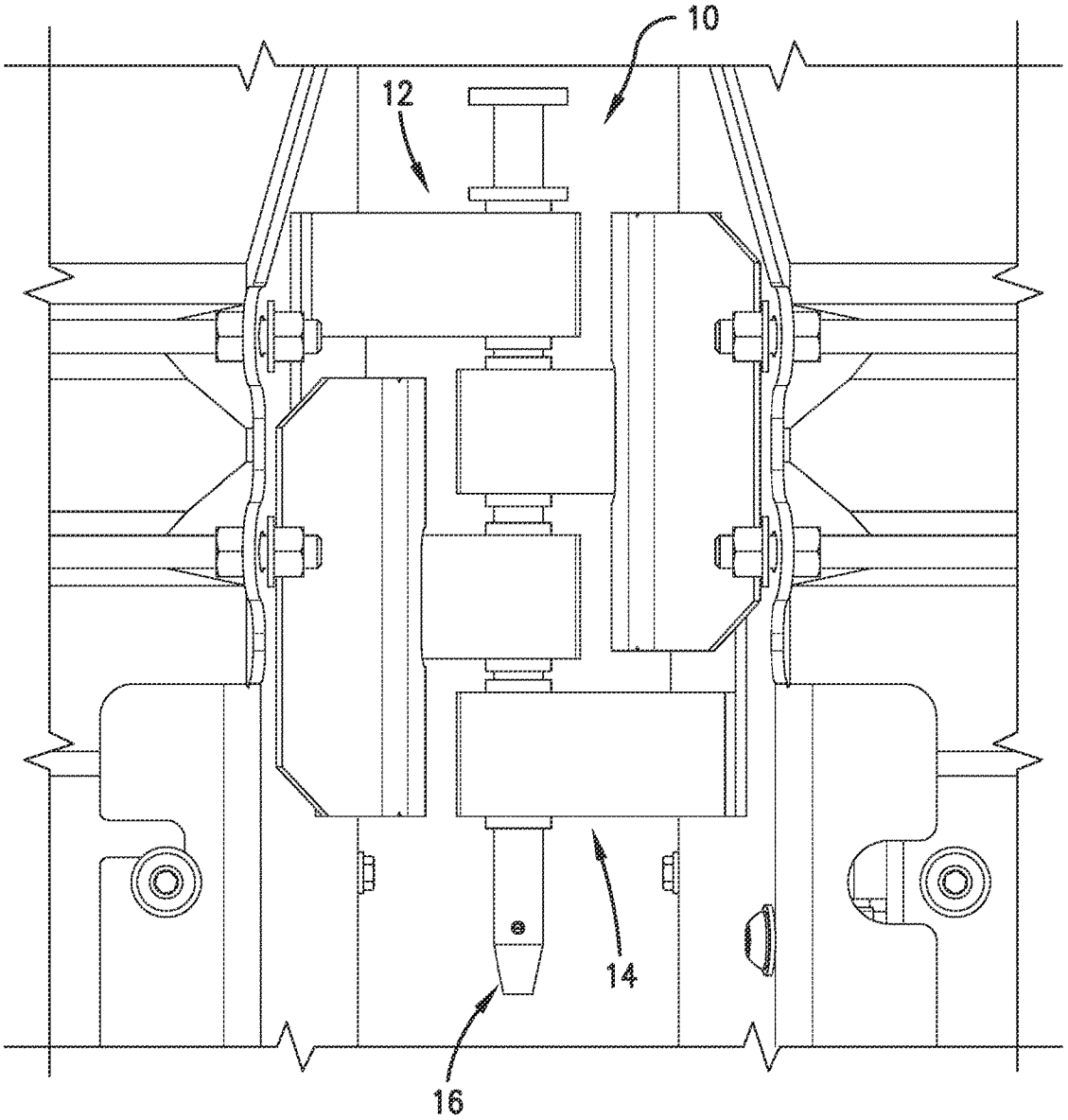
FIG. 2 is an enlarged view of the collapsible hinge from FIG. 1.

The first end barrier 102 and several of the intermediate barriers 106 closest to the first end barrier 102 each include a wedge 128 positioned on a bottom side of the barrier 102, 104, 106. When the first intermediate barrier 106A impacts the second intermediate barrier 106B, the wedge 128 of the first intermediate barrier 106A lifts the second intermediate barrier 106B from the bottom. The second hinge assembly 14A rises along with the first end wall 108B. Referring to FIG. 2 the spacing between the bushing 48B of the second base 20B of the second hinge assembly 14B and the bushing 48A of the second base 20A of the first hinge assembly 12A and the spacing between the bushing 40B of the first base 18B of the second hinge assembly 14B and the bushing 40A of the first base 18A of the first hinge assembly 12A each allow for the second intermediate barrier 106B to rise a short distance before the bushings 40A, 40B, 48A, 48B contact.

Figure 9:
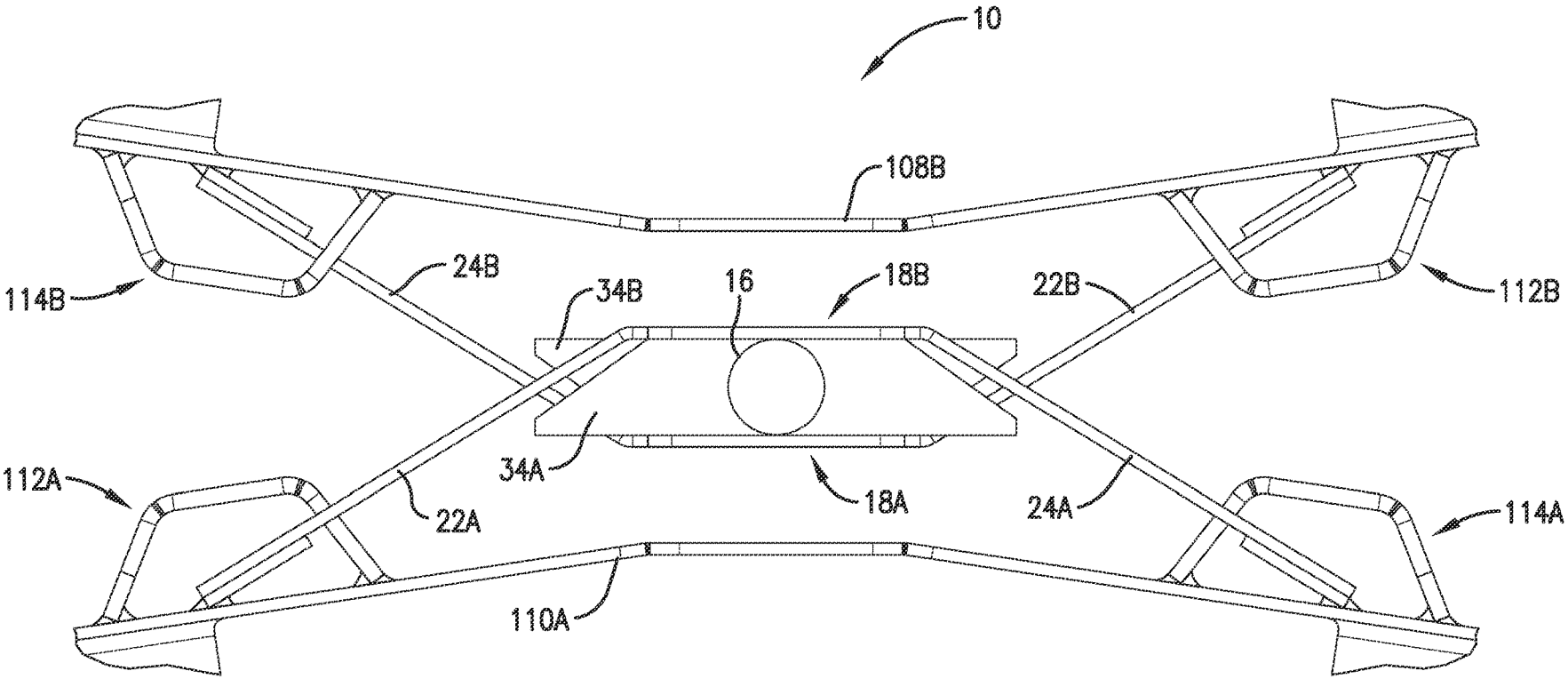
FIG. 9 is a top view of the collapsible hinge, the second end wall of the first intermediate barrier, and a first end wall of the second intermediate barrier.
Figure 10:
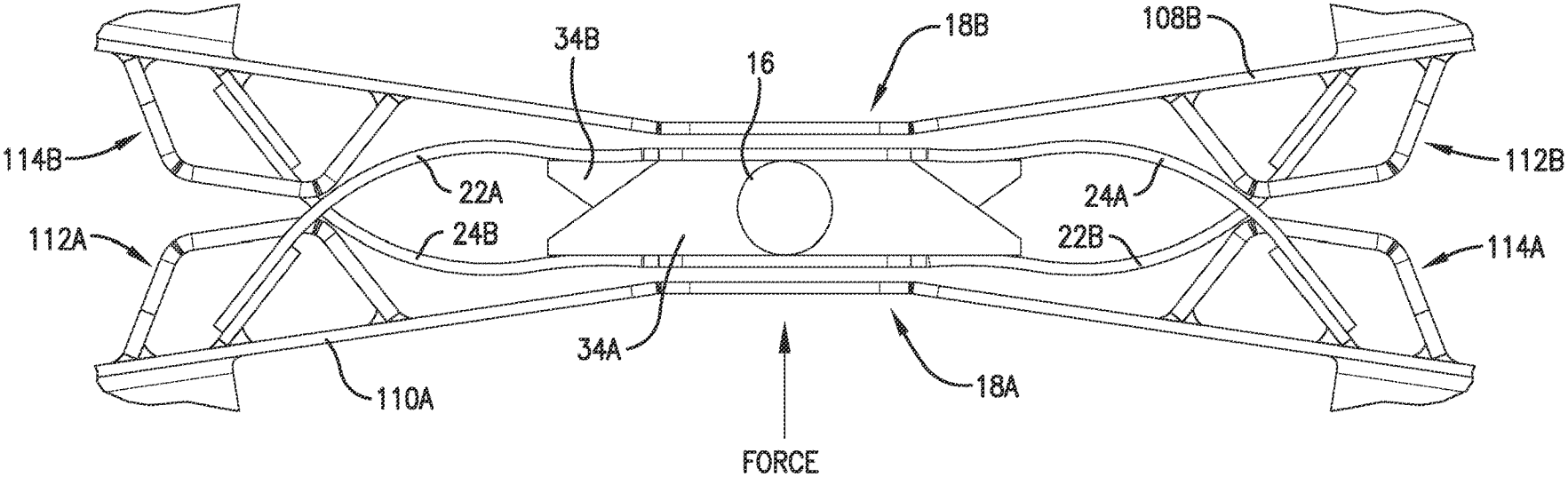
FIG. 10 is a top view of the collapsible hinge, the second end wall of the first intermediate barrier, and the first end wall of the second intermediate barrier, with the collapsible hinge in a collapsed state after a vehicle impacts the roadway barrier system.
Figure 11:
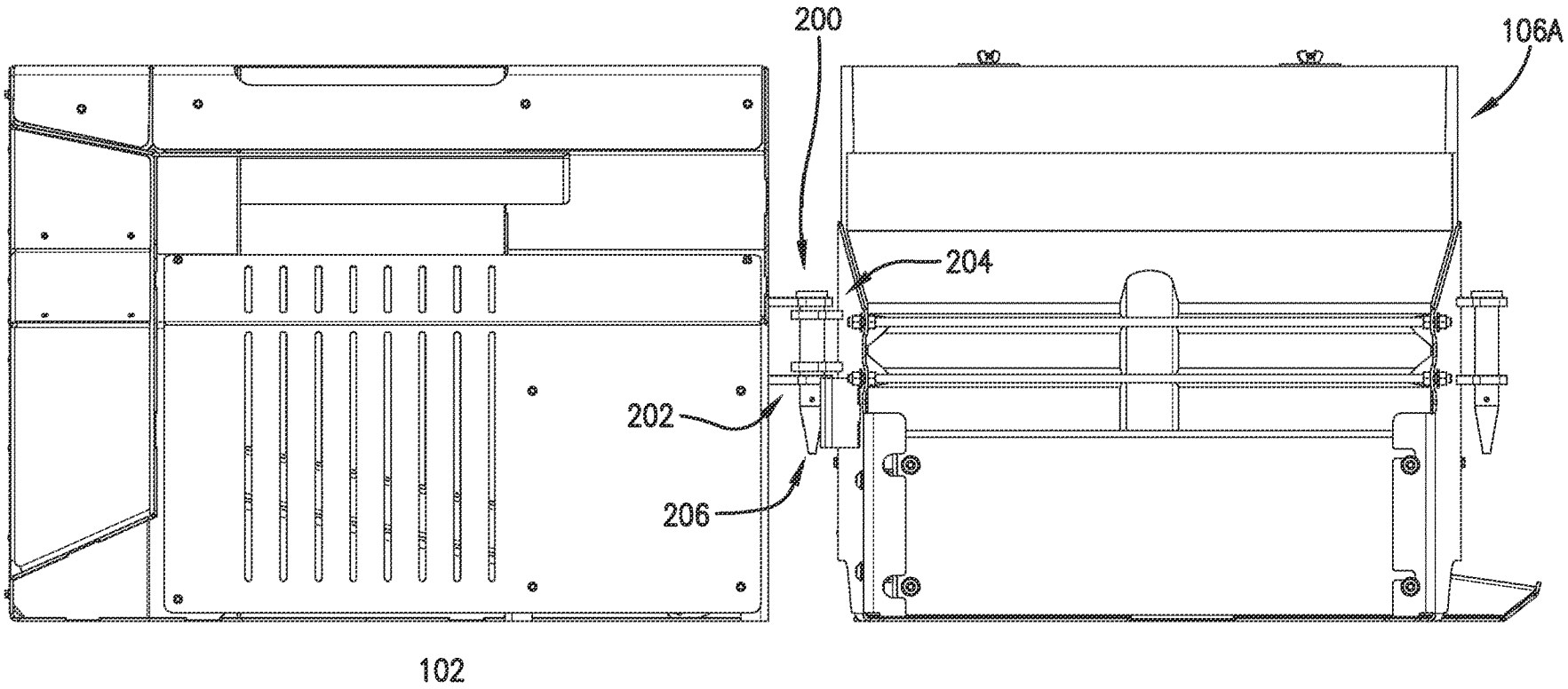
FIG. 11 is a side view of a solid hinge, constructed in accordance with other embodiments of the current invention, for use with the roadway barrier system, from which, the first end barrier and the first intermediate barrier are shown, the solid hinge including a first hinge assembly, a second hinge assembly, and a pin.
Figure 12:
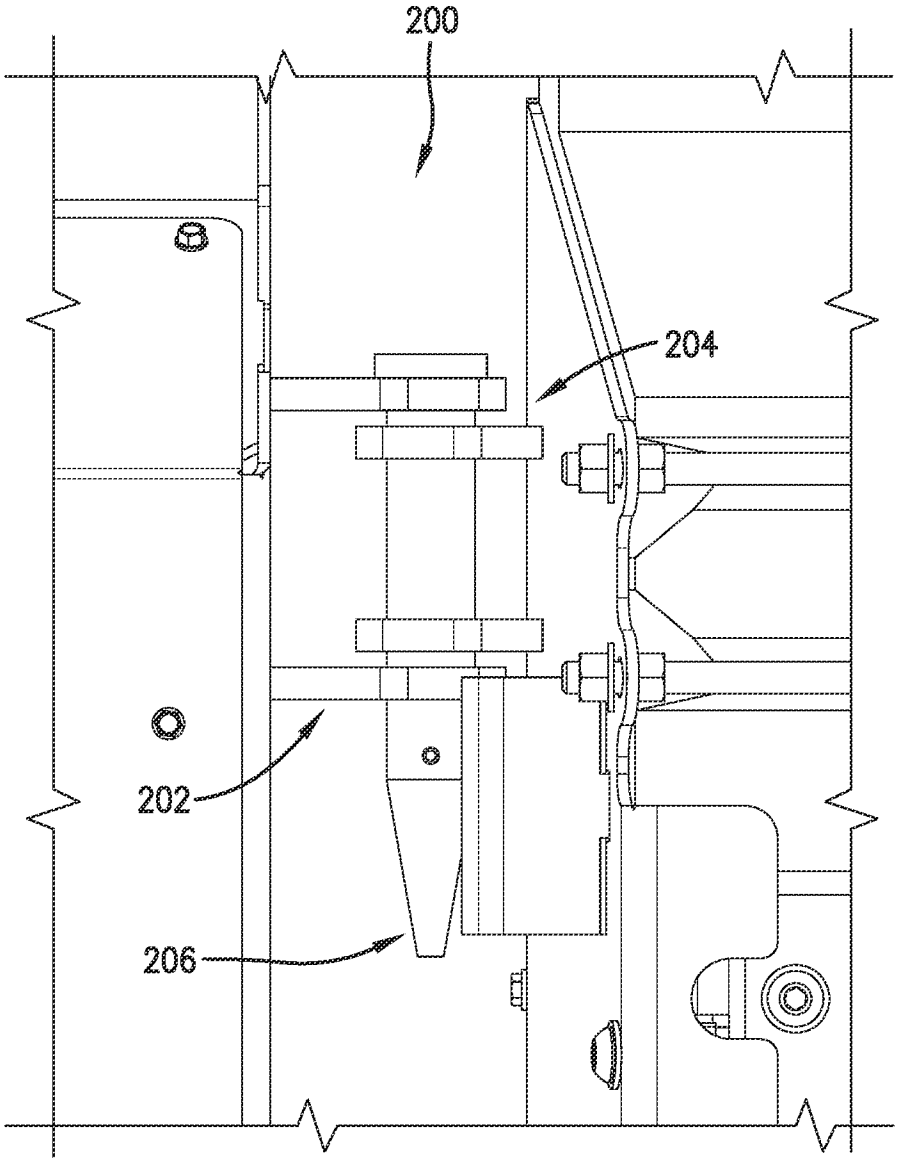
FIG. 12 is an enlarged view of the solid hinge from FIG. 11.
Figure 13:
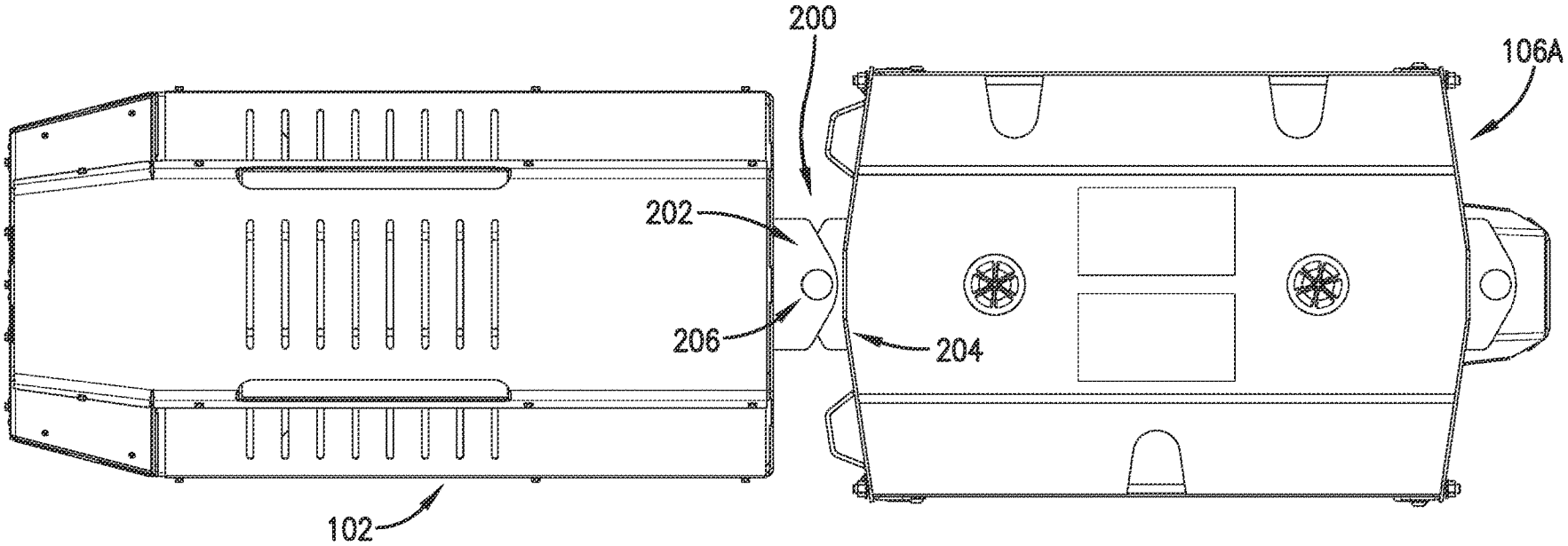
FIG. 13 is a top view of the solid hinge, the first end barrier, and the first intermediate barrier.
Figure 14:
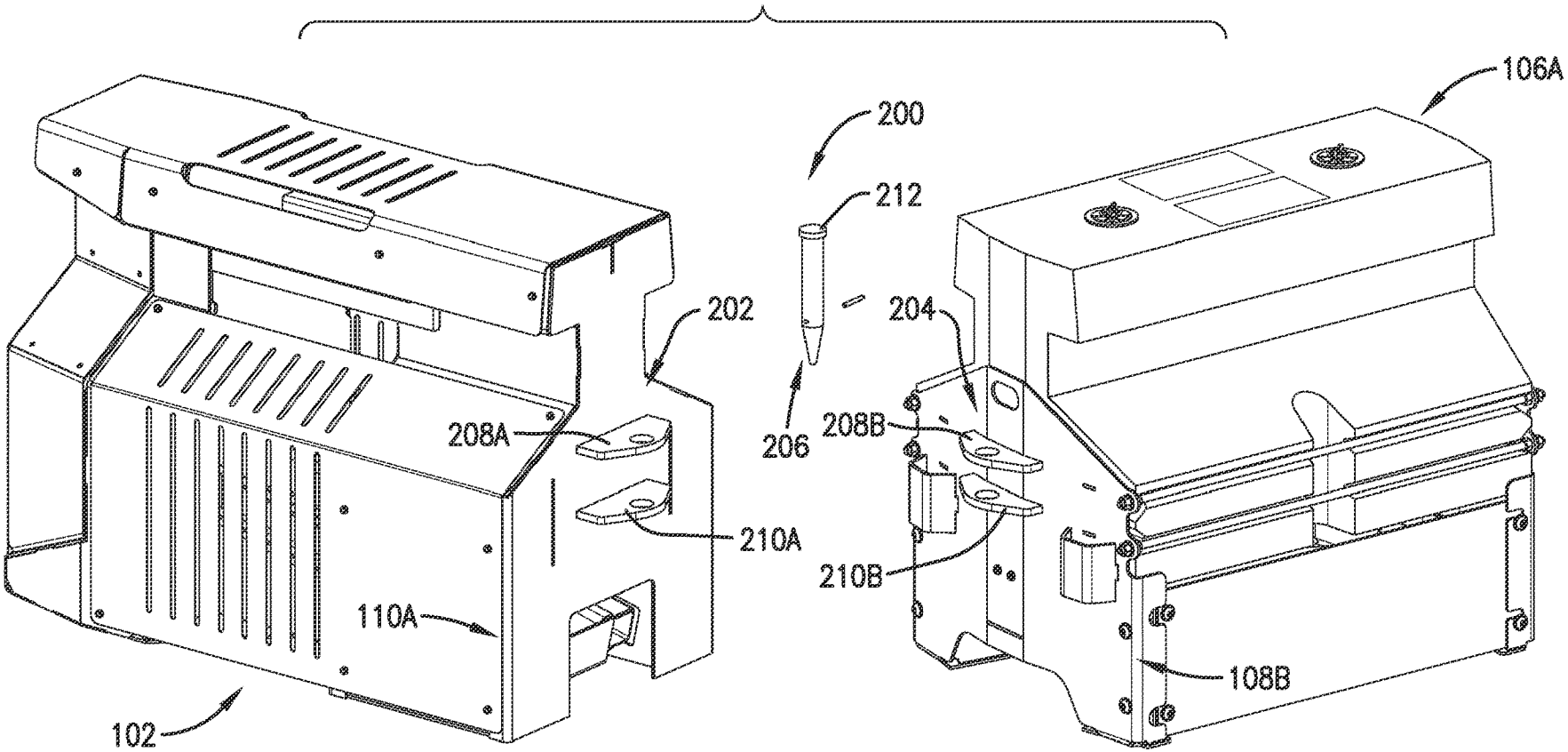
FIG. 14 is an upper perspective view of the solid hinge, the first end barrier, and the first intermediate barrier with the first hinge assembly, the second hinge assembly, and the pin separated from one another.
Figure 15:
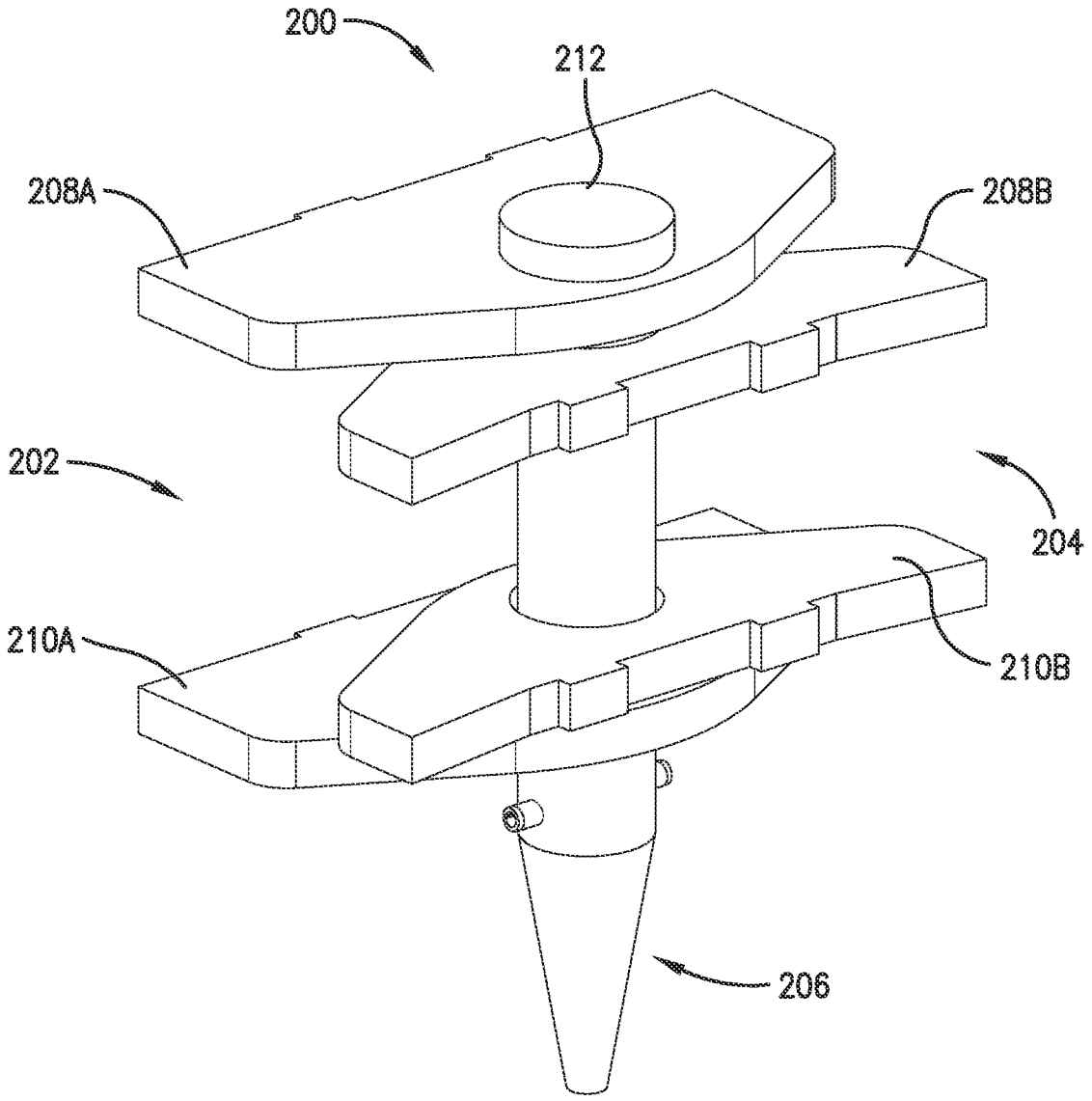
FIG. 15 is a perspective view from the rear of the second hinge assembly of the solid hinge in isolation.
Figure 16:
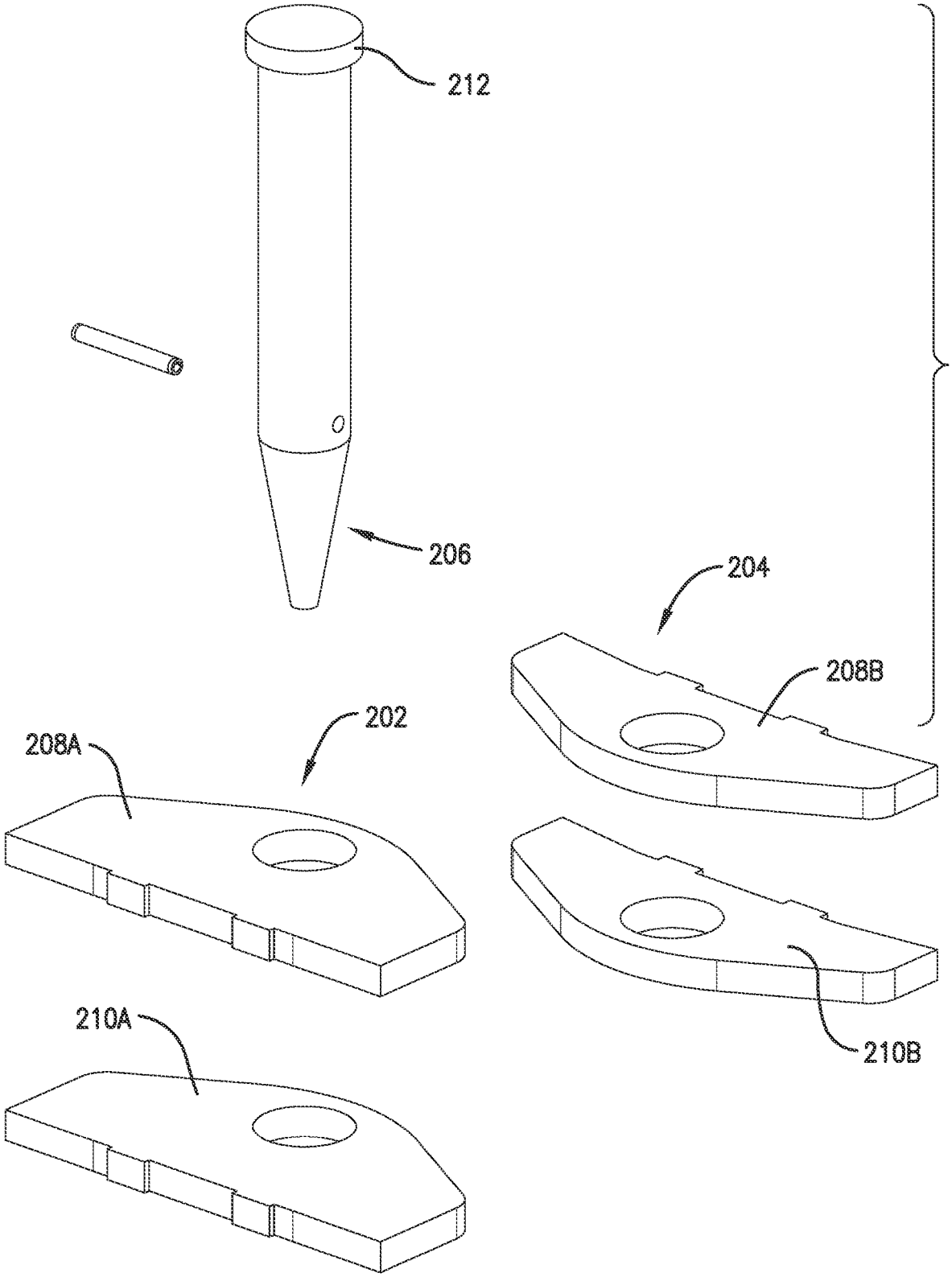
FIG. 16 is an exploded perspective view from the rear of the first hinge assembly of the solid hinge in isolation.

The forcing of one barrier 102, 104, 106 into the barrier 102, 104, 106 after it causes the collapsible hinge 10 between the two barriers 102, 104, 106 to collapse. Referring to FIGS. 9 and 10, a top view of the collapsible hinge 10, the second end wall 110A of the first intermediate barrier 106A, and the first end wall 108B of the second intermediate barrier 106B are shown. In addition, the left bumper 112A, 112B and the right bumper 114A, 114B of each end wall 108, 110 are shown. The force from the vehicle impact moves the second end wall 110A toward the first end wall 108B until the left bumper 112A of the second end wall 110A contacts the right bumper 114B of the first end wall 108B and the right bumper 114A of the second end wall 110A contacts the left bumper 112B of the first end wall 108B, as shown in FIG. 10. As the first hinge assembly 12 is pushed toward the first end wall 108B, it pushes on the pin 16, which in turn pushes on the second hinge assembly 14, forcing the first base 18A, 18B and the second base 20A, 20B of each hinge assembly 12, 14 to move toward the first end wall 108B. Given that the first left arm 22A and the first right arm 24A are not connected to the left and right side surfaces, respectively, of the upper plate 34A and the lower plate 36A of the first base 18A, the motion of the first base 18A toward the first end wall 108B causes the first left arm 22A and the first right arm 24A to buckle or bend. In some instances, the first left arm 22A and the first right arm 24A may bend outward, away from the left and right side surfaces, respectively, of the upper plate 34A and the lower plate 36A of the first base 18A. The second left arm 26A and the second right arm 28A of the first hinge assembly 12, the first left arm 22B and the first right arm 24B, the second left arm 26B and the second right arm 28B of the second hinge assembly 14 may behave in the same, or similar, fashion—buckling or bending outward, away from the side surfaces of the upper and lower plates 34A, 34B, 36A, 36B, 42A, 42B, 44A, 44B of the respective first and second bases 18A, 18B, 20A, 20B, as shown in FIG. 10.

A solid hinge 200, constructed in accordance with other embodiments of the current invention, is shown in FIGS. 11-16. A plurality of solid hinges 200 is also utilized with the roadway barrier system 100 shown in FIG. 3. Each solid hinge 200 broadly comprises a first hinge assembly 202, a second hinge assembly 204, and a pin 206, as shown in isolation in FIGS. 15 and 16. The hinge assemblies 202, 204 have a similar structure, and each hinge assembly 202, 204 includes an upper plate 208A, 208B and a lower plate 210A, 210B. The upper plate 208A and the lower plate 210A for the first hinge assembly 202 and the upper plate 208B and the lower plate 210B for the second hinge assembly 204 each have a top surface, a bottom surface, a front surface, a back surface, a left surface, and a right surface. The front surface has a generally arcuate shape, and the rear surface includes a first tab and a second tab, each extending outward therefrom. Each plate 208A, 208B, 210A, 210B further includes an opening that extends from the top surface to the bottom surface.

The pin 206 has a generally cylindrical structure that tapers to a point at a lower end and is attached to a disc shaped cap 212 at an upper end. The pin 206 further includes an opening or a hole adjacent to the lower end through which a cotter pin or similar locking component is positioned.

The upper plate 208A and the lower plate 210A of the first hinge assembly 202 are spaced apart from one another vertically. Each plate 208A, 210A is connected to an outer surface of the second end wall 110A of the first end barrier 102, such that the first tab and the second tab of each plate 208A, 210A extends through a successive one of four openings on the second end wall 110A. The upper plate 208B and the lower plate 210B of the second hinge assembly 204 are spaced apart from one another vertically. Each plate 208B, 210B is connected to an outer surface of the first end wall 108B of the first intermediate barrier 106A, such that the first tab and the second tab of each plate 208B, 210B extends through a successive one of four openings on the first end wall 108B. The plates 208A, 208B, 210A, 210B are connected to the respective end walls 108B, 110A so as to form a stack with the upper plate 208A of the first hinge assembly 202 being positioned above, and spaced apart from, the upper plate 208B of the second hinge assembly 204. The lower plate 210B of the second hinge assembly 204 is positioned above, and spaced apart from, the lower plate 210A of the first hinge assembly 202. The pin 206 is positioned in the opening of each plate 208A, 208B, 210A, 210B.

Throughout this specification, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current invention can include a variety of combinations and/or integrations of the embodiments described herein.

Although the present application sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112 (f) unless traditional means-plus-function language is expressly recited, such as "means for" or "step for" language being explicitly recited in the claim(s).

Although the technology has been described with reference to the embodiments illustrated in the attached drawing figures, it is noted that equivalents may be employed and substitutions made herein without departing from the scope of the technology as recited in the claims.

Having thus described various embodiments of the technology, what is claimed as new and desired to be protected by Letters Patent includes the following:

The invention claimed is:

1. A collapsible hinge for use with a roadway barrier system including a plurality of barriers, the collapsible hinge comprising:

a first hinge assembly connected to an end wall of a first barrier, the first hinge assembly including:

a first base including upper and lower surfaces and an opening extending from the upper surface to the lower surface, and a second base including upper and lower surfaces and an opening extending from the upper surface to the lower surface;

a second hinge assembly connected to an end wall of a second barrier, the second hinge assembly including:

a first base including upper and lower surfaces and an opening extending from the upper surface to the lower surface, and a second base including upper and lower surfaces and an opening extending from the upper surface to the lower surface, wherein the first base or the second base of the second hinge assembly is positioned between the first base and the second base of the first hinge assembly; and wherein the each hinge assembly includes a first left arm and a first right arm each connected to a front surface of the first base, a second left arm and a second right arm each connected to a front surface of the second base, a left arm connector connecting the first left arm to the second left arm, and a right arm connector connecting the second left arm to the second right arm, such that the first left arm, the first right arm, the second left arm, the left arm connector, and the right arm connector are each connected to the end wall of the first barrier or the second barrier; and a pin positioned in the opening of each base of each hinge assembly.

2. The collapsible hinge of claim 1, wherein the first base of the first hinge assembly includes a first bushing positioned in its opening and the second base of the first hinge assembly includes a second bushing positioned in its opening, the first base of the second hinge assembly includes a first bushing positioned in its opening and the second base of the second hinge assembly includes a second bushing positioned in its opening, and the pin is positioned in the first bushing and the second bushing of the first hinge assembly and the first bushing and the second bushing of the second hinge assembly.

3. The collapsible hinge of claim 1, wherein, for each base of each hinge assembly, the first left arm, the first right arm, the second left arm, and the second right arm each buckle or bend during a front impact to the roadway barrier system.

4. The collapsible hinge of claim 1, wherein, for each hinge assembly, the first base includes an upper plate, a spaced apart lower plate, and a front plate connected to a front surface of each of the upper plate and the lower plate, the first left arm is connected to a left edge of the front plate, and the first right arm is connected to a right edge of the front plate.

5. The collapsible hinge of claim 4, wherein the upper plate and the lower plate each include an upper surface, a lower surface, a front surface, a back surface, and left and right side surfaces, and the upper surface and the lower surface each have a general trapezoidal shape.

6. The collapsible hinge of claim 1, wherein, for each hinge assembly, the second base includes an upper plate, a spaced apart lower plate, and a front plate connected to a front surface of each of the upper plate and the lower plate, the second left arm is connected to a left edge of the front plate, and the second right arm is connected to a right edge of the front plate.

7. The collapsible hinge of claim 6, wherein the upper plate and the lower plate each include an upper surface, a lower surface, a front surface, a back surface, and left and right side surfaces, and the upper surface and the lower surface each have a general trapezoidal shape.

8. The collapsible hinge of claim 3, wherein each base of each hinge assembly includes a left side surface and a right side surface, and, for each base of each hinge assembly, the first left arm, the first right arm, the second left arm, and the second right arm each buckle or bend away from the left side surface and the right side surface during the front impact to the roadway barrier system.

9. A collapsible hinge for use with a roadway barrier system including a plurality of barriers, the collapsible hinge comprising:

a first hinge assembly connected to an end wall of a first barrier, the first hinge assembly including:

a first base including an upper surface, a lower surface, and a front surface, a first left arm and a first right arm each connected to the front surface of the first base, a second base including an upper surface, a lower surface, and a front surface, and a second left arm and a second right arm each connected to the front surface of the second base;

a second hinge assembly connected to an end wall of a second barrier, the second hinge assembly including:

a first base including an upper surface, a lower surface, and a front surface, a first left arm and a first right arm each connected to the front surface of the first base, a second base including an upper surface, a lower surface, and a front surface, and a second left arm and a second right arm each connected to the front surface of the second base, wherein, for each hinge assembly, the first left arm, the first right arm, the second left arm, and the second right arm each buckle or bend during a front impact to the roadway barrier system; and a pin coupled to each base of each hinge assembly.

10. The collapsible hinge of claim 9, wherein the first base or the second base of the second hinge assembly is positioned between the first base and the second base of the first hinge assembly.

11. The collapsible hinge of claim 9, wherein the first base of the first hinge assembly includes a first bushing positioned in an opening that extends from the upper surface to the lower surface and the second base of the first hinge assembly includes a second bushing positioned in an opening that extends from the upper surface to the lower surface, the first base of the second hinge assembly includes a first bushing positioned in an opening that extends from the upper surface to the lower surface and the second base of the second hinge assembly includes a second bushing positioned in an opening that extends from the upper surface to the lower surface, and the pin is positioned in the first bushing and the second bushing of the first hinge assembly and the first bushing and the second bushing of the second hinge assembly.

12. The collapsible hinge of claim 9, wherein the each hinge assembly includes a left arm connector connecting the first left arm to the second left arm, and a right arm connector connecting the second left arm to the second right arm.

13. The collapsible hinge of claim 12, wherein, for each hinge assembly, the first left arm, the first right arm, the second left arm, the second right arm, the left arm connector, and the right arm connector are each connected to the end wall of the first barrier or the second barrier.

14. The collapsible hinge of claim 9, wherein, for each hinge assembly, the first base includes an upper plate, a spaced apart lower plate, and a front plate connected to a front surface of each of the upper plate and the lower plate, the first left arm is connected to a left edge of the front plate, and the first right arm is connected to a right edge of the front plate.

15. The collapsible hinge of claim 14, wherein the upper plate and the lower plate each include an upper surface, a lower surface, a front surface, a back surface, and left and right side surfaces, and the upper surface and the lower surface each have a general trapezoidal shape.

16. The collapsible hinge of claim 9, wherein, for each hinge assembly, the second base includes an upper plate, a spaced apart lower plate, and a front plate connected to a front surface of each of the upper plate and the lower plate, the second left arm is connected to a left edge of the front plate, and the second right arm is connected to a right edge of the front plate.

17. The collapsible hinge of claim 16, wherein the upper plate and the lower plate each include an upper surface, a lower surface, a front surface, a back surface, and left and right side surfaces, and the upper surface and the lower surface each have a general trapezoidal shape.

18. The collapsible hinge of claim 17, wherein, for each base of each hinge assembly, the first left arm, the first right arm, the second left arm, and the second right arm each buckle or bend away from the left side surface and the right side surface of the upper plate and the lower plate during the front impact to the roadway barrier system.

19. A collapsible hinge for use with a roadway barrier system including a plurality of barriers, the collapsible hinge comprising:

a first hinge assembly connected to an end wall of a first barrier, the first hinge assembly including:

a first base including an upper surface, a lower surface, a front surface, an opening extending from the upper surface to the lower surface, and a first bushing positioned in the opening, a first left arm and a first right arm each connected to the front surface of the first base, a second base including an upper surface, a lower surface, a front surface, an opening extending from the upper surface to the lower surface, and a second bushing positioned in the opening, a second left arm and a second right arm each connected to the front surface of the second base, a left arm connector connecting the first left arm to the second left arm, and a right arm connector connecting the first right arm to the second right arm;

a second hinge assembly connected to an end wall of a second barrier, the second hinge assembly including:

a first base including an upper surface, a lower surface, a front surface, an opening extending from the upper surface to the lower surface, and a first bushing positioned in the opening, a first left arm and a first right arm each connected to the front surface of the first base, a second base including an upper surface, a lower surface, a front surface, an opening extending from the upper surface to the lower surface, and a second bushing positioned in the opening, a second left arm and a second right arm each connected to the front surface of the second base, a left arm connector connecting the first left arm to the second left arm, and a right arm connector connecting the first right arm to the second right arm, wherein the first base or the second base of the second hinge assembly is positioned between the first base and the second base of the first hinge assembly, and for each hinge assembly, the first left arm, the first right arm, the second left arm, and the second right arm each buckle or bend during a front impact to the roadway barrier system; and a pin positioned in the first bushing and the second bushing of each hinge assembly.

* * * * *